US006147457A

United States Patent [19]

Löhn et al.

[11] Patent Number: 6,147,457

[45] Date of Patent: Nov. 14, 2000

[54] INCANDESCENT LAMP WITH CONTINUOUS HIGH-FREQUENCY OSCILLATIONS

[75] Inventors: Klaus Löhn, Simmerath-Lammersdorf; Ulrich Böke, Geilenkirchen; Bernd Hofmann, Aachen, all of Germany

[73] Assignee: U.S. Philips Corporation, New York, N.Y.

[21] Appl. No.: 09/145,096

[22] Filed: Sep. 1, 1998

[30] Foreign Application Priority Data

Sep. 3, 1997 [EP] European Pat. Off. ..... 97202712
Dec. 8, 1997 [EP] European Pat. Off. ..... 97203842

[51] Int. Cl.[7] ..... H05B 41/00

[52] U.S. Cl. ..... 315/209 R; 315/224; 315/276; 315/219

[58] Field of Search ..... 315/56, 58, 205, 315/291, 294, DIG. 7, 209 R, 363, 276, 224, 219

[56] References Cited

U.S. PATENT DOCUMENTS

| | | | |
|---|---|---|---|
| 4,751,435 | 6/1988 | Roche et al. | 315/56 |
| 4,998,044 | 3/1991 | Nilssen | 315/200 |
| 5,144,202 | 9/1992 | Nilssen | 315/225 |
| 5,239,233 | 8/1993 | Nilssen | 315/276 |
| 5,331,253 | 7/1994 | Counts | 315/219 |
| 5,382,880 | 1/1995 | Mitsuhashi et al. | 315/205 |
| 5,410,221 | 4/1995 | Mattas et al. | 315/DIG. 7 |
| 5,426,347 | 6/1995 | Nilssen | 315/363 |
| 5,600,208 | 2/1997 | Katou et al. | 315/56 |
| 5,883,469 | 3/1999 | Noll et al. | 315/58 |

*Primary Examiner*—Don Wong
*Assistant Examiner*—Wilson Lee
*Attorney, Agent, or Firm*—Robert J. Kraus

[57] ABSTRACT

An incandescent lamp with a low voltage burner (BM) and integrated voltage conversion means (VCM) having switching elements (Q1, Q2) driven by a separate control circuit (CC) comprising an integrated circuit (IC). The voltage conversion means are suitable for operation at a high temperature and causes only limited amounts of EMI.

13 Claims, 3 Drawing Sheets

INCANDESCENT LAMP WITH CONTINUOUS HIGH-FREQUENCY OSCILLATIONS

BACKGROUND OF THE INVENTION

The invention relates to an incandescent lamp, equipped with

- a base for connection into a lamp socket, the base comprising a pair of base terminals for receiving an AC supply voltage with frequency f,
- voltage conversion means comprising
  - rectifying means having input terminals coupled to the pair of base terminals and output terminals,
  - capacitive means coupled to the output terminals and equipped with a series arrangement comprising two capacitors,
  - switching means coupled to the series arrangement comprising two capacitors for generating a first high frequency voltage out of the voltage present over the series arrangement comprising two capacitors,
  - transformer means, coupled to the switching means and comprising a primary winding and a secondary winding, for transforming the first high frequency voltage into a second high frequency voltage,
- low voltage incandescent burner means coupled to the secondary winding,
- envelope means, comprising at least a first translucent part, the envelope means being fastened to the base and together with the base enclosing the voltage conversion means and the low voltage incandescent burner means.

The invention also relates to voltage conversion means for use in such an incandescent lamp and to an adapter for supplying an incandescent lamp from an AC supply voltage source with a high frequency voltage comprising such voltage conversion means.

An incandescent lamp as mentioned in the opening paragraph is known from U.S. Pat. No. 4,998,044. The known incandescent lamp is an incandescent halogen lamp. In the known lamp, the switching means comprises a series arrangement of two switching elements shunting the series arrangement of the two capacitors. The two capacitors and the two switching elements together form a half bridge circuit. The primary winding of the transformer means is coupled between a common terminal of the two capacitors and a common terminal of the two switching elements. During lamp operation the first high frequency voltage is transformed by the transformer means into the second high frequency voltage that is present over the low voltage incandescent burner. The second high frequency voltage has a maximal amplitude that matches the maximal operating voltage of the low voltage incandescent burner means. The capacitances of the two capacitors are equal and are chosen relatively low. Because of these relatively low values of the capacitances, the capacitors are relatively small which makes it relatively easy to integrate the voltage conversion means into the incandescent halogen lamp. Furthermore these low values of the capacitances cause a relatively low mains current distortion which corresponds to a relatively high value of the power factor of the voltage conversion means and to a relatively low value of the total harmonic distortion. At the same time, however, these relatively low values of the capacitances causes the voltage present over the series arrangement of the two capacitors to drop to a very low value two times in every period of the AC supply voltage. In the voltage conversion means comprised in the known incandescent halogen lamp the bridge circuit is a self-oscillating circuit wherein control signals or rendering the switching elements conducting and non-conducting are derived from the current flowing through the primary winding of the transformer means by means of saturable current transformers. With a frequency 2f, however, the voltage over the capacitors becomes so low that the control signals become too weak to control the conductive state of the switching elements resulting in the bridge circuit stopping its oscillation. To be able to start oscillation once more when the voltage over the capacitors has once more reached a value that is high enough, the voltage conversion means of the known incandescent halogen lamp is equipped with a circuit part for restarting the oscillation. This circuit part comprises ohmic resistors, a startcapacitor and a DIAC. The startcapacitor is charged from the voltage over the two capacitors. When the voltage over the startcapacitor is high enough, the DIAC becomes conductive, at the same time renders one of the switching elements conductive and thereby restarts the oscillation of the bridge circuit.

Although the voltage conversion means comprised in the known incandescent halogen lamp allow the realization of a relatively high power factor and a relatively low amount of total harmonic distortion, its use is also associated with some serious disadvantages. The voltage conversion means, since they are integrated in the lamp, are at a relatively high temperature during stationary operation. A DIAC on the other hand generally has a relatively low maximum operating temperature. To make sure that the DIAC still operates under worst case conditions, the voltage conversion means have to be designed so that the amount of power that can be consumed by the low voltage burner is relatively low. Furthermore the favourable effect that the low values of the capacitance of the capacitors comprised in the capacitive means have on the power factor is counteracted to a certain extent by the fact that the supply current drops to zero during a certain time lapse two times in every period of the AC supply voltage. Additionally in a self-oscillating circuit each switching element is rendered conductive while a voltage is present over it. This is called "hard switching" as opposed to "soft switching" meaning that each switch is rendered conductive while the voltage over it is approximately zero. Because of the hard switching a relatively high amount of power is dissipated in the switching elements increasing the total amount of heat generated and thereby the operational temperature of the voltage conversion means. Another effect of the hard switching is the generation of EMI, necessitating the incorporation of a relatively big filter in the voltage conversion means in order to make the lamp meet the requirements regarding EMI. This relatively big filter makes it very difficult to incorporate the voltage conversion means in the lamp. In a self-oscillating circuit, EMI can also be caused by a lack of symmetry of the first high frequency voltage caused by component tolerances.

SUMMARY OF THE INVENTION

The invention aims to provide an incandescent lamp that has a high power factor and a relatively low total harmonic distortion and wherein the voltage conversion means can be so designed that the amount of power consumed by the low voltage incandescent burner means is relatively high.

According to the invention the voltage conversion means comprises a control circuit CC comprising an integrated circuit for generating a control signal for rendering the switching means alternately conducting and non-conducting.

The control circuit CC keeps generating the control signal for rendering the switching means alternately conducting and non-conducting irrespective of the momentary amplitude of the voltage present over series arrangement comprising two capacitors, so that it is not necessary to start the oscillation of the voltage conversion means every half period of the AC supply voltage and a circuit part for restarting the oscillation can be dispensed with. For this reason the capacitive means can be chosen relatively small, so that the power factor of an incandescent lamp according to the invention is relatively high and the amount of total harmonic distortion is relatively small. The integrated circuit is capable of operating at a much higher temperature than the circuit part for restarting the oscillation comprised in the prior art lamp disclosed in U.S. Pat. No. 4,998,044. Because the voltage conversion means of an incandescent lamp according to the invention can operate at a relatively high temperature, they can consume a relatively high amount of power and can be relatively small, making it easier to integrate the voltage conversion means into the lamp. Because the generation of the control signal is realized by means of the integrated circuit the switching of the switching means is soft switching, so that the amount of power dissipated in the switching means is relatively low and therefore only a minor contribution to the total amount of heat generated in the lamp. Furthermore the symmetry of the control signal generated by the integrated circuit is independent of component tolerances and therefore relatively high. As a result the amount of EMI generated is relatively small so that if a filter is incorporated into the voltage conversion means, it can be relatively small.

Good results have been obtained with incandescent lamps according to the invention that were incandescent halogen lamps.

Preferably the switching means comprises a series arrangement comprising two switching elements and shunting the series arrangement of the two capacitors. The two series arrangements together form a so called half bridge circuit. Such a half bridge circuit is very suitable for generating the first high frequency voltage.

Since the low voltage burner is relatively small, the light emitted by the lamp can be concentrated in a beam in case part of the inner surface of the translucent envelope means is covered with a reflector. The reflector also acts as a heat shield for the voltage conversion means by reflecting the light and the infrared radiation generated by the low voltage incandescent burner means.

Preferably the base for connection into a lamp socket is a screw base suitable for connection into an Edison-type lamp socket.

It is advantageous if the incandescent lamp comprises means for controlling the amount of power consumed by the low voltage incandescent burner means. Such means for controlling the consumed power can for instance prevent an increase in the power consumed by the lamp in case the maximal amplitude of the AC supply voltage is relatively high. If the maximal amplitude of the AC supply voltage is relatively high the means for controlling the power consumed by the lamp decrease the consumed power to a level that is lower than would be the case if these control means were absent. In this way the lamp parts, more in particular the low voltage burner means, are protected from becoming too hot.

An incandescent lamp according to the invention may alternatively comprise means for reducing the power consumed by the low voltage burner means in dependency of the temperature of the voltage conversion means. The means for reducing the power consumed by the low voltage burner means in dependency of the temperature of the voltage conversion means prevent the lamp parts from becoming too hot when for instance the ambient temperature is relatively high.

Preferably the voltage conversion means comprise filter means to reduce the amount of EMI caused by the first high frequency voltage.

Preferably the voltage conversion means are so dimensioned that the power factor of the incandescent lamp is at least 0.75. The power factor of the incandescent lamp is strongly influenced by the capacitance of the capacitors comprised in the capacitive means. These are the capacitors in the series arrangement and, if filter means are present any capacitor(s) comprised in the filter means. By properly choosing the capacitance of the capacitors comprised in the capacitive means, the power factor of the incandescent lamp can be adjusted at at least 0.75. In case filter are present, the power factor is of course also influenced by any inductive means comprised in such filter means.

In a preferred embodiment of an incandescent lamp according to the invention, the envelope means comprises in addition to the first translucent part a housing fastened between the base and the translucent envelope means. Such a housing can for instance be made out of plastic. It has been found that this preferred embodiment can be manufactured relatively easily.

The use of a voltage conversion means, as comprised in the embodiments of an incandescent lamp according to the invention as described hereabove, in an adapter for supplying an incandescent lamp (not equipped with its own voltage conversion means) offers the same important advantages as outlined hereabove for the use of such voltage conversion means in an incandescent lamp. Such an adapter is suitable for use with an incandescent lamp that is equipped with a low voltage incandescent burner means and a lamp base. The adapter is equipped with means I for connection to poles of the AC supply voltage source and means II for connecting to the base of the incandescent lamp. The means I generally comprise a lamp base and the means II generally comprise a lamp socket. The means I are coupled to the input terminals of the rectifying means of the voltage conversion means and the means II are coupled to the secondary winding of the transformer means of the voltage conversion means. During operation, when the means I are connected to the AC supply voltage source and the means II are connected to the lamp base, the voltage conversion means comprised in the adapter generates the second high frequency voltage out of the AC supply voltage supplied by the AC supply voltage source. Via the lamp base the second high frequency voltage is coupled to the low voltage incandescent burner means comprised in the incandescent lamp.

DETAILED DESCRIPTION OF THE PREFERRED EMBODIMENTS

Figure 1:
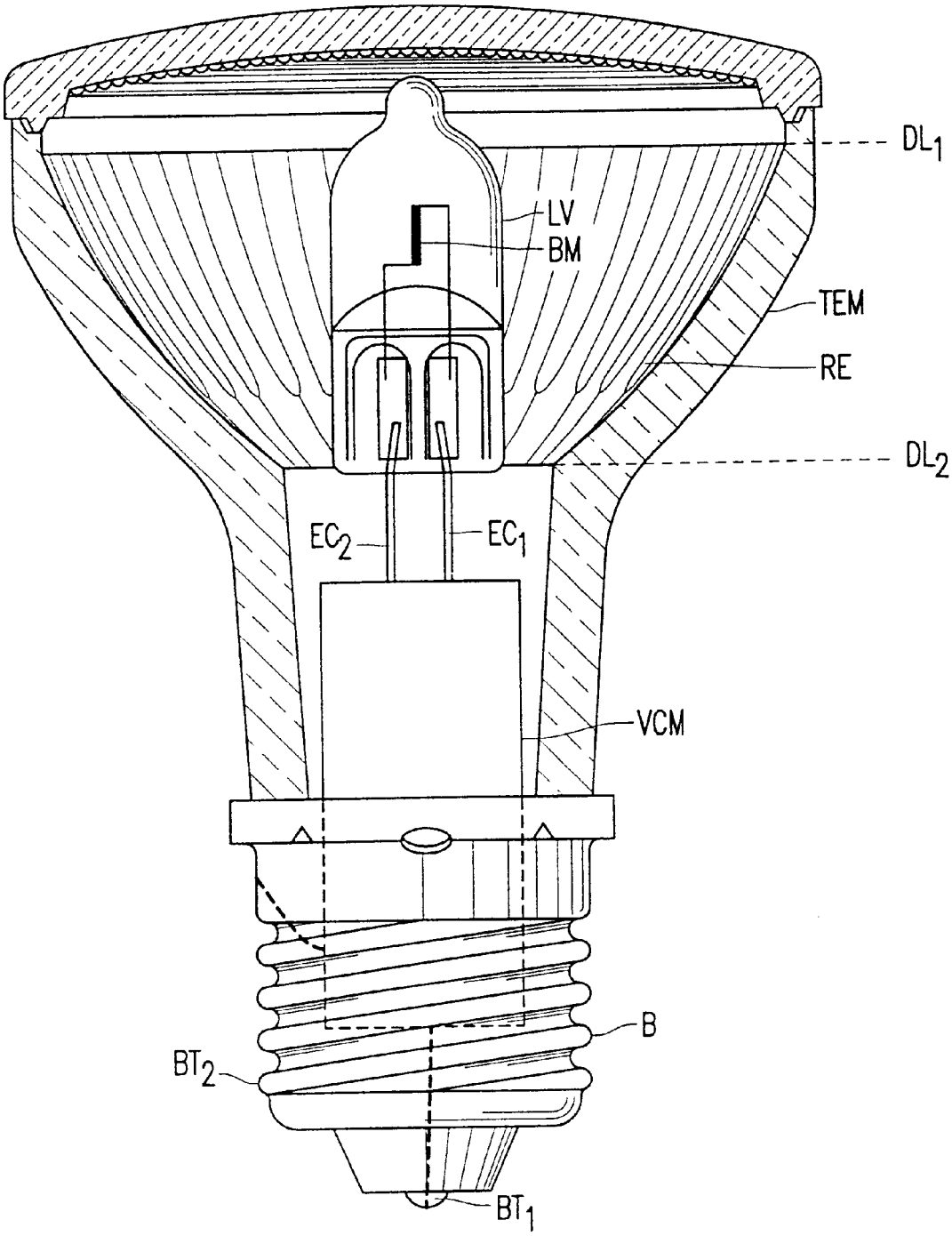
FIG. 1 shows a schematic representation of an embodiment of an incandescent lamp according to the invention partly in cross section.

In FIG. 1, B is a base suitable for connection into an Edison-type lamp socket. BT1 and BT2 are a pair of base terminals for receiving an AC supply voltage. VCM are voltage conversion means connected to base terminals BT1 and BT2. The voltage conversion means VCM are coupled to low voltage incandescent burner means BM by means of electrical conductors EC1 and EC2. The low voltage incandescent burner means BM are enclosed by a gastight glass lamp vessel LV. TEM are envelope means, that in this embodiment comprise only a translucent part, fastened to the base. Between the parallel planes that are represented by means of dotted lines DL1 and DL2, the inner surface of the translucent envelope means TEM is covered with a reflector RE, which in this embodiment consists of a layer of aluminium.

Figure 2:
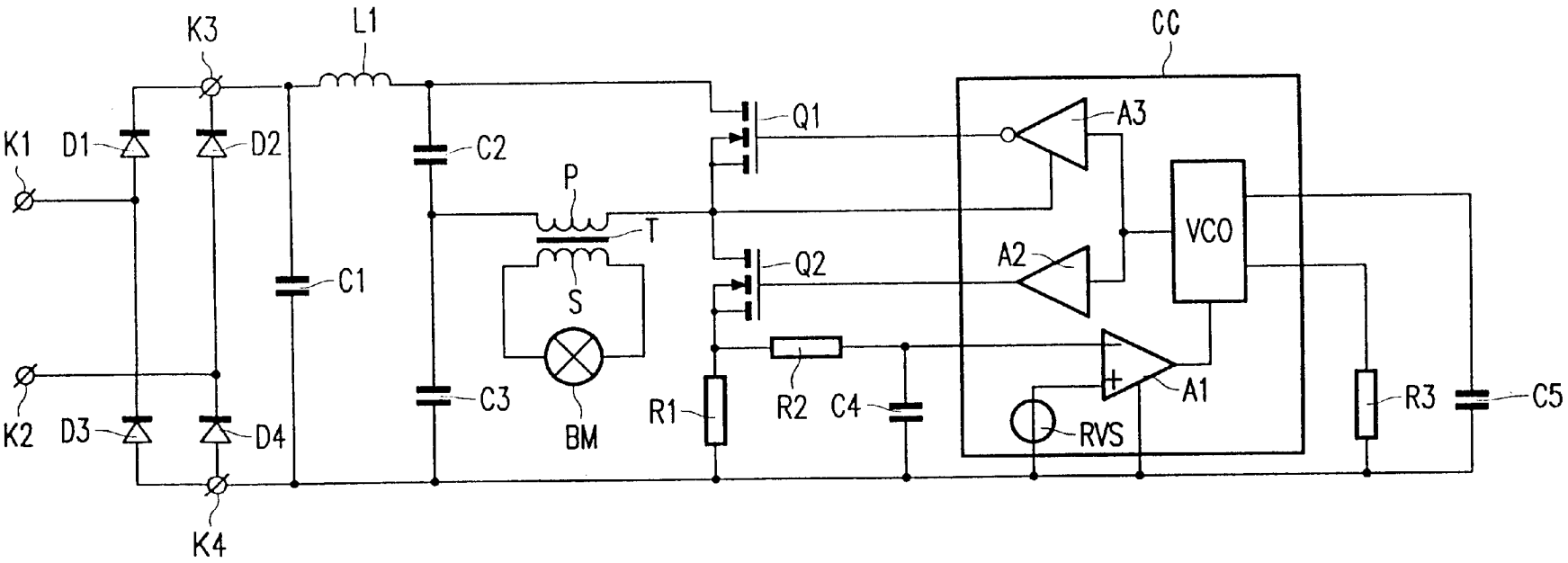
FIG. 2 shows a schematic representation of the voltage conversion means comprised in the incandescent lamp shown in FIG. 1.

In FIG. 2, K1 and K2 are terminals for connection to the base terminals BT1 and BT2. Diodes D1–D4 are rectifying means formed in this embodiment by a diode bridge. Input terminals of the diode bridge are coupled to the terminals K1 and K2. Output terminals K3 and K4 of the diode bridge are coupled to capacitive means formed by capacitor C1 and a series arrangement of capacitors C2 and C3. Capacitor C1 is shunted by a series arrangement of choke L1 and switching elements Q1 and Q2. Capacitor C1 and choke L1 form filter means. Switching elements Q1 and Q2 form switching means for generating a first high frequency voltage out of the voltage present over the series arrangement of capacitors C2 and C3. The series arrangement of capacitors C2 and C3 shunts a series arrangement of switching elements Q1 and Q2 and resistor R1. A common terminal of switching elements Q1 and Q2 is connected to a common terminal of capacitors C2 and C3 by means of a primary winding P of transformer means T. The low voltage burner means BM shunts a secondary winding S of transformer means T. Control electrodes of switching elements Q1 and Q2 are connected to respective output terminals of an integrated circuit CIC for generating a control signal for rendering the switching elements alternately conducting and non-conducting. Resistor R1 is shunted by a series arrangement of resistor R2 and capacitor C4. A common terminal of resistor R2 and capacitor C4 is connected to a first input terminal of amplifier A1. A second input terminal of amplifier A1 is connected to an output terminal of reference voltage source RVS. An output terminal of amplifier A1 is connected to a first input terminal of voltage controlled oscillator VCO. An output of voltage controlled oscillator VCO is connected to both an input terminal of amplifier A2 as well as an input terminal of inverting amplifier A3. A second input terminal of voltage controlled oscillator VCO is connected to output terminal K4 of the diode bridge by means of resistor R3. A third input terminal of voltage controlled oscillator VCO is connected to output terminal K4 of the diode bridge by means of capacitor C5. Resistors R1 and R2, capacitor C4, reference voltage source RVS and amplifier A1 together form means for controlling the amount of power consumed by the low voltage incandescent burner means in dependency of the maximum amplitude of the AC supply voltage. The integrated circuit CIC together with resistor R3 and capacitor C5 forms a control circuit CC. Amplifiers A1, A2 and A3, reference voltage source RVS and voltage controlled oscillator VCO are all part of the integrated circuit CIC.

The voltage conversion means shown in FIG. 2 function as follows.

Figure 2A:
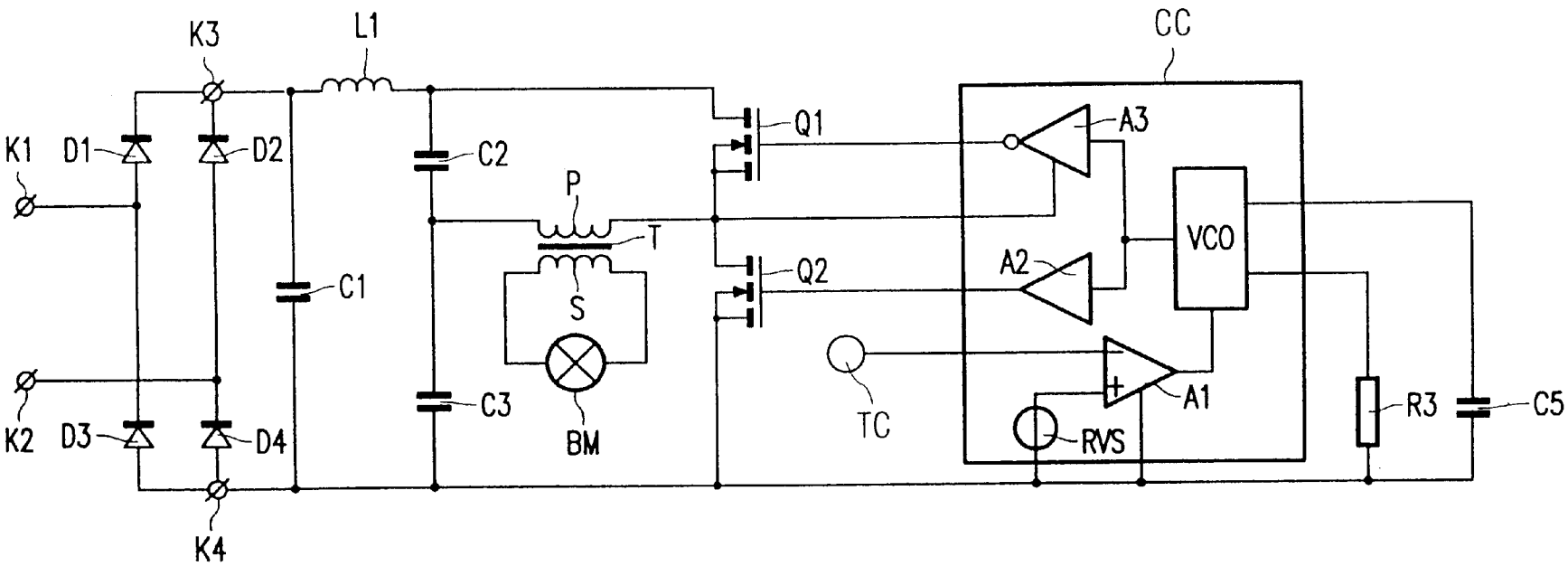
FIG. 2A shows an alternative voltage conversion circuit utilizing a temperature sensor.

When the terminals K1 and K2 are connected to the poles of a source of an AC supply voltage with frequency f this AC supply voltage is rectified by the diode bridge D1–D4. As a result a DC voltage is present over capacitor C1 and another DC voltage is present over the series arrangement of capacitor C2 and C3. The dimensioning of the capacitors C1, C2 and C3 is such that the DC voltage that is present over the series arrangement of capacitors C2 and C3 drops to a very low value with a frequency 2f. As a result of this dimensioning the power factor of the voltage conversion means is high. Voltage controlled oscillator VCO generates a high frequency signal present at its output that is amplified by means of amplifiers A2 and A3 to a control signal that renders the switching elements Q1 and Q2 alternately conducting and non-conducting at a high frequency. As a result a first high frequency voltage is generated out of the DC voltage over the series arrangement of capacitors C2 and C3. Since the generation of the control signal is maintained also when the momentary amplitude of the AC supply voltage is close to zero, there is no need to restart the voltage conversion means in every half period of the AC supply voltage. The first high frequency voltage is present over the primary winding P of the transformer means T. The transformer means T transform the first high frequency voltage into a second high frequency voltage that is present over the secondary winding S of the transformer means T and over the low voltage burner means BM. The transformer means are so dimensioned that the maximal amplitude of the second high frequency voltage corresponds to the maximum voltage that can be applied to the low voltage burner means BM. If the maximal amplitude of the AC supply voltage increases, the maximal amplitude of the current through resistor R1 increases. The average amplitude of the current through resistor R1 increases too. Resistor R2 and capacitor C4 together form a low pass filter acting as an integrator so that the signal present at the first input terminal of amplifier A1 is proportional to the average value of the amplitude of the current in resistor R1. The current through resistor R1 is approximately proportional to the lamp current and, since the low voltage incandescent burner means BM are an ohmic load, also is a measure for the lamp power. Thus, the signal present at the first input terminal of amplifier A1 is a measure for the average value of the power consumed by the lamp. The reference voltage source generates a voltage that is a measure for the desired value of the average power consumed by the lamp. The output signal of amplifier A1 controls the frequency of the signal present at the output terminal of voltage controlled oscillator VCO at such a value that the average power consumed by the lamp is approximately at the desired level irrespective of the maximum amplitude of the AC supply voltage. FIG. 2A illustrates an alternative configuration of the voltage conversion means shown in FIG. 2, the first input terminal of amplifier A1 is connected to a temperature sensor TC comprised in the voltage conversion means and the resistors R1 and R2 and the capacitor C4 can be dispensed with. In this alternative configuration the reference voltage source RVS generates a signal that is a measure for a desired value of the temperature of the electronics comprised in the voltage conversion means. As a consequence the output signal of amplifier A1 controls the frequency of the signal present at the output terminal of voltage controlled oscillator VCO at such a value that the temperature of the electronics comprised in the voltage conversion means is approximately at the desired level irrespective of the ambient temperature. In this alternative embodiment the temperature sensor, the temperature reference source and amplifier A1 constitute means for controlling the power consumed by the low voltage burner means in dependency of the temperature of the voltage conversion means. During operation the filter formed by capacitor C1 and choke L1 reduces the amount of EMI that is caused by the high frequency switching of the switching elements Q1 and Q2. As a result the voltage conversion means do not only have a high power factor but also cause only a relatively small amount of total harmonic distortion.

In a practical embodiment of an incandescent lamp according to the invention the voltage conversion means were configured as in FIG. 2. The low voltage burner had a nominal voltage of 12 Volt and consumed approximately 21 Watt. Capacitors C1, C2 and C3 each had a capacitance of 47 nF, while choke L1 had an inductance of 470 $\mu$H. The winding ratio of the transformer was 96/12 and the frequency of the lamp current was 40 kHz. It has been found that the power factor of the lamp was over 99% and that the lamp easily met the IEC 82 requirements for THD. At the same time the voltage conversion means were small enough to be comprised in the lamp so that the lamp also met the IEC-1520-1 requirements and can be used in any lampholder equipped with an Edison type lamp socket.

What is claimed is:

1. An incandescent lamp, comprising:

a base for connection into a lamp socket, said base comprising a pair of base terminals for receiving an AC supply voltage with frequency f, voltage conversion means comprising:

rectifying means having:

input terminals coupled to said pair of base terminals and output terminals, capacitive means coupled to the output terminals and equipped with a first series arrangement comprising two capacitors, switching means coupled to the first series arrangement for generating a first high frequency voltage out of the voltage present over the first series arrangement, and transformer means, coupled to the switching means and comprising a primary winding and a secondary winding, for transforming the first high frequency voltage into a second high frequency voltage, low voltage incandescent burner means coupled to the secondary winding, and envelope means, comprising at least one translucent part, said envelope means being fastened to the base and together with the base enclosing the voltage conversion means and the low voltage incandescent burner means, characterized in that the voltage conversion means further comprises a control circuit comprising an integrated circuit for generating a control signal for rendering the switching means alternately conducting and non-conducting substantially independent of the frequency f of the AC supply voltage.

2. An incandescent lamp according to claim 1, wherein the incandescent lamp is an incandescent halogen lamp.

3. An incandescent lamp according to claim 1, wherein the switching means comprises a second series arrangement comprising two switching elements that are configured to shunt the first series arrangement.

4. An incandescent lamp according to claim 1, wherein part of the inner surface of the translucent envelope means is covered with a reflector.

5. An incandescent lamp according to claim 1, wherein the base for connection into a lamp socket is a screw base suitable for connection into an Edison-type lamp socket.

6. An incandescent lamp according to claim 1, wherein the voltage conversion means comprise means for controlling the amount of power consumed by the low voltage incandescent burner means.

7. An incandescent lamp according to claim 1 comprising means for controlling the power consumed by the low voltage burner means in dependency of the temperature of the voltage conversion means.

8. An incandescent lamp according to claim 1, wherein the voltage conversion means comprise filter means.

9. An incandescent lamp according to claim 1, wherein the voltage conversion means are so dimensioned that the power factor of the incandescent lamp is at least 0.75.

10. An incandescent lamp according to claim 1, wherein the envelope means comprises a housing fastened between the base and the translucent envelope means.

11. An incandescent lamp according to claim 10, wherein the housing is made of plastic.

12. Voltage conversion means suitable for use in an incandescent lamp comprising:

a rectifier having:

input terminals coupled to an AC supply voltage with frequency f and output terminals, a series arrangement of capacitors operably coupled to the output terminals of the rectifier, a switch arrangement, operably coupled to the series arrangement that is configured to generate a first high frequency voltage, and a transformer, operably coupled to the switch arrangement and the series arrangement, comprising:

a primary winding that receives the first high frequency voltage, and a secondary winding, that provides a corresponding second high frequency voltage that powers the incandescent lamp, and a control circuit that generates a control signal for controlling the switch arrangement substantially independent of the frequency f of the AC supply voltage.

13. An adapter for supplying an incandescent lamp, said incandescent lamp being equipped with a low voltage incandescent burner means and a lamp base, the adapter being configured to receive power from an AC supply voltage source at a frequency f, and to provide therefrom a high frequency voltage to the incandescent lamp, the adapter comprising:

a rectifier having input terminals coupled to the AC supply voltage and output terminals, a series arrangement comprising two capacitors operably coupled to the output terminals of the rectifier, a switch arrangement, operably coupled to the series arrangement that is configured to provide the high frequency voltage to the incandescent lamp via a transformer, and a control circuit that is configured to generate a control signal for rendering the switching means alternately conducting and non-conducting substantially independent of the frequency f of the AC supply voltage.

* * * * *